US005866285A

United States Patent [19]

Anderson et al.

[11] Patent Number: 5,866,285

[45] Date of Patent: Feb. 2, 1999

[54] AUXILIARY LAYER FOR IMAGING ELEMENTS CONTAINING SOLVENT-SOLUBLE FLUOROPOLYMER

[75] Inventors: Charles C. Anderson; Yongcai Wang, both of Penfield, N.Y.

[73] Assignee: Eastman Kodak Company, Rochester, N.Y.

[21] Appl. No.: 873,609

[22] Filed: Jun. 12, 1997

[51] Int. Cl.[6] ..... G03C 1/89; G03C 1/76; G03G 5/147

[52] U.S. Cl. ..... 430/41; 430/56; 430/66; 430/200; 430/201; 430/527; 430/536; 430/512; 430/961; 503/227; 346/135.1

[58] Field of Search ..... 430/527, 536, 430/537, 539, 961, 950, 512, 41, 56, 66, 200, 201; 503/227; 346/135.1

[56] References Cited

U.S. PATENT DOCUMENTS

| | | | |
|---|---|---|---|
| 3,589,906 | 6/1971 | McDowell | 430/535 |
| 3,666,478 | 5/1972 | Grah et al. | 96/114.5 |
| 3,884,609 | 5/1975 | Britten | 425/242 |
| 3,888,678 | 6/1975 | Bailey et al. | 430/528 |
| 4,203,769 | 5/1980 | Guestaux | 430/631 |
| 4,314,043 | 2/1982 | Kojima et al. | 525/102 |
| 4,330,618 | 5/1982 | Minamizono et al. | 430/528 |
| 4,487,893 | 12/1984 | Yamabe et al. | 525/386 |
| 4,701,508 | 10/1987 | Homma et al. | 526/249 |
| 4,897,457 | 1/1990 | Nakamura et al. | 526/247 |
| 4,910,276 | 3/1990 | Nakamura et al. | 526/247 |
| 5,300,676 | 4/1994 | Andree et al. | 560/56 |
| 5,460,919 | 10/1995 | Obi et al. | 430/139 |
| 5,462,832 | 10/1995 | Iwasaki | 430/139 |
| 5,475,229 | 12/1995 | Itabashi et al. | 250/483 |
| 5,482,813 | 1/1996 | Tadashi | 430/139 |
| 5,510,406 | 4/1996 | Matsuo et al. | 524/237 |
| 5,532,304 | 7/1996 | Miyazaki et al. | 524/261 |
| 5,576,160 | 11/1996 | Goan et al. | 430/509 |
| 5,597,680 | 1/1997 | Wang et al. | 430/536 |
| 5,597,681 | 1/1997 | Anderson et al. | 430/536 |

*Primary Examiner*—Richard L. Schilling
*Attorney, Agent, or Firm*—Carl R. Ruoff

[57] ABSTRACT

The present invention is an imaging element including a support, at least one image-forming layer and an auxiliary layer. The auxilary layer is formed by providing a coating composition of a fluoroolefin-vinyl ether copolymer dissolved in an organic medium, coating the coating composition on the support and drying the coating composition. The present invention also includes a coating composition for use in an imaging element including a fluoroolefin-vinyl ether copolymer dissolved in an organic medium.

15 Claims, No Drawings

AUXILIARY LAYER FOR IMAGING ELEMENTS CONTAINING SOLVENT-SOLUBLE FLUOROPOLYMER

CROSS REFERENCE TO RELATED APPLICATIONS

This application relates to commonly assigned copending application Ser. No. 08/873,648, filed simultaneously herewith and hereby incorporated by reference for all that it discloses. This application relates to commonly assigned copending application Ser. No. 08/873,607, Express Mail No. EM579617714US filed simultaneously herewith and hereby incorporated by reference for all that it discloses.

FIELD OF THE INVENTION

This invention relates in general to imaging elements such as, for example, photographic elements and in particular to imaging elements comprising a support, an image-forming layer and one or more hydrophobic auxiliary layers. More specifically, this invention relates to such imaging elements which have an improved hydrophobic auxiliary layer exhibiting superior physical and chemical characteristics. The hydrophobic auxiliary layer contains a fluoroolefin-vinyl ether copolymer and is applied from an organic solvent.

BACKGROUND OF THE INVENTION

The imaging elements to which this invention relates can be of many different types depending on the particular use for which they are intended. Such elements include, for example, photographic, electrophotographic, electrostatographic, photothermographic, migration, electrothermographic, dielectric recording and thermal-dye-transfer imaging elements.

Layers of imaging elements other than the image-forming layer are commonly referred to as auxiliary layers. There are many different types of auxiliary layers such as, for example, subbing layers, backing layers, overcoat layers, receiving layers, stripping layers, antistatic layers, transparent magnetic layers, and the like.

Support materials for an imaging element often employ auxiliary layers comprising glassy, hydrophobic polymers such as polyacrylates, polymethacrylates, polystyrenes, or cellulose esters, for example. One typical application for such an auxiliary layer is as a backing layer to provide resistance to abrasion, scratching, blocking, and ferrotyping. Backing layers may be applied directly onto the support material, applied onto a priming or "subbing" layer, or applied as an overcoat for an underlying layer such as an antistatic layer, transparent magnetic layer, or the like. When the backing layer is an overcoat for an antistatic layer the backing layer may need to protect the antistatic layer from attack by film processing solutions in order to preserve the antistatic properties of the film after image processing. For example, U.S. Pat. No. 4,203,769 describes a vanadium pentoxide-containing antistatic layer that is overcoated with a cellulosic layer applied from an organic solvent.

The problem of controlling static charge is well known in the photographic art. The accumulation and discharge of static charges can lead to a variety of problems such as dirt and dust attraction, coating imperfections such as mottle, and static marking. The accumulation of static charge is related to both the electrical conductivity and the charging characteristics of the imaging element. Incorporation of conductive agents such as salts, semiconductive metal oxide fillers and polymers, for example, in auxiliary layers has been used effectively in the photographic art as a means of increasing the electrical conductivity of an imaging element.

The accumulation of static charge may be reduced by controlling the triboelectric charge generated on the surface of imaging elements as a result of friction and separation of surfaces during the manufacture and use of the imaging element. The incorporation of fluorine-containing surface active agents in the surface layers of imaging elements as a means of controlling triboelectric charge generation has been disclosed, for example, in U.S. Pat. Nos. 3,589,906, 3,666,478, 3,884,609, 3,888,678, 4,330,618, and others. European Patent Application EP 0 693 709 A describes a light sensitive material having at least one hydrophilic colloid layer containing in combination, at least one fluoropolymer and at least one fluorochemical surface active agent. Such layers reportedly improve the antistatic behavior of the light sensitive material. Typical compositions in this patent application comprise gelatin as the hydrophilic colloid, fluorochemical surface active agent, and an aqueous dispersion of fluoropolymer. Such hydrophilic layers would be expected to have poor barrier performance and abrasion resistance and not be coatable from organic solvent.

Frequently, when the auxiliary layer serves as the outermost layer, as is the case for a backing layer, it is desirable for this layer to have a low coefficient of friction (COF) to provide proper conveyance properties and to protect the imaging element from mechanical damage during the manufacturing process or customer use. It is known to protect imaging elements against mechanical damage by coating them with a layer comprising a lubricant such as a wax. However, it has proven difficult to provide a single layer applied from organic medium that comprises both an abrasion-resistant polymer and a lubricant since it is difficult to find a coating medium that dissolves both the polymer and the lubricant and is at the same time attractive from an environmental and health standpoint. In addition, it is difficult to form a stable dispersion of a lubricant such as a wax in an organic medium that may be added to a coating composition containing a dissolved, abrasion-resistant polymer. Therefore, in order to form a backing layer which can be applied from liquid organic medium that is both abrasion-resistant and has a low coefficient of friction one often applies two separate layers; a first layer which is comprised of an abrasion-resistant polymer and then a second layer which is comprised of a lubricant such as a wax. The need to apply these two separate layers increases both manufacturing complexity and cost.

While the aforementioned prior art references relate to some aspects of the present invention, they are deficient with regard to simultaneously satisfying all the physical, chemical, and manufacturing requirements for providing an improved auxiliary layer for imaging elements that is applied from organic solvent. The present invention provides a coating composition which may be applied from organic solvent and forms a dried layer with excellent physical and chemical properties such as transparency, abrasion resistance, coefficient of friction, triboelectric charging, and barrier properties.

SUMMARY OF THE INVENTION

The present invention is an imaging element including a support, at least one image-forming layer and an auxiliary layer. The auxilary layer is formed by providing a coating composition of a fluoroolefin-vinyl ether copolymer dissolved in an organic, medium, coating the coating composition on the support and drying the coating composition.

The present invention also includes a coating composition for use in an imaging element including a fluoroolefin-vinyl ether copolymer dissolved in an organic medium.

DESCRIPTION OF THE INVENTION

The imaging elements of this invention can be of many different types depending on the particular use for which they are intended. Details with respect to the composition and function of a wide variety of different imaging elements are provided in U.S. Pat. No. 5,300,676 and references described therein.

Photographic elements can comprise various polymeric films, papers, glass, and the like, but both acetate and polyester supports well known in the-art are preferred. The thickness of the support is not-critical. Support thickness of 2 to 10 mil (0.002 to 0.010 inches) can be used. The supports typically employ an undercoat or subbing layer well known in the art that comprises, for example, for polyester support a vinylidene chloride/methyl acrylate/itaconic acid terpolymer or vinylidene chloride/acrylonitrile/acrylic acid terpolymer.

The auxiliary layers of the present invention contain a fluoroolefin-vinyl ether copolymer and are applied from an organic solvent. Fluoropolymers possess many desirable attributes such as low friction coefficient, chemical and stain resistance, water resistance, and thermal stability. In general, however, fluoropolymers have poor solubility in organic solvents and their high melting points require the use of high temperature baking, for example, as high as 300° C., to form useful films. The insolubility and high melting points for most fluoropolymers are not compatible with the manufacturing processes used in the photographic industry. Therefore, up to now it has been extremely difficult to utilize fluoropolymers to form hydrophobic auxiliary layers for imaging elements.

The fluoropolymers of the present invention are copolymers comprising fluoroolefin monomer units and vinyl ether monomer units. The fluoroolefin-vinyl ether copolymers may additionally contain small amounts of other copolymerizable monomer components such as α-olefins, cycloolefins and unsaturated carboxylic acids.

The fluoroolefin-vinyl ether copolymer has in the molecule at least one fluorine atom and preferably includes perhaloolefins, in which hydrogen atoms of the olefin have all been substituted with fluorine atoms and other halogen atoms, particularly-preferable are perfluoroolefins. Examples of such fluoroolefins as mentioned above include fluoroethylenes and fluoropropenes, and particularly tetrafluoroethylene. Also included are chlorotrifluoroethylene, trifluoroethylene, vinylidene fluoride, hexafluoropropylene, pentafluoropropylene, and others. The use of the above-exemplified fluoroolefins either singly or in admixture is included in the embodiments of the present invention.

The vinyl ether monomer includes compounds having ether linkages of a vinyl group with an alkyl group (including cycloalkyl), aryl group, or arylalkyl group or the like group. Of these compounds, preferred are alkyl vinylethers, particularly those having ether linkages of a vinyl group with an alkyl group having less than 8 carbon atoms, preferably 2 to 4 carbon atoms.

Examples of such vinyl ethers as mentioned above include alkyl vinyl ethers such as ethyl vinyl ether, propyl vinyl ether, isopropyl vinyl ether, butyl vinyl ether, tert-butyl vinyl ether, pentyl vinyl ether, hexyl vinyl ether, isohexyl vinyl ether, octyl vinyl ether, and 4-methyl-1-pentyl vinyl ether; cycloalkyl vinyl ethers such as cyclopentyl vinyl ether and cyclohexyl vinyl ether; aryl vinyl ethers such as phenyl vinyl ether, o-, m- and p-chlorotolyl vinyl ether, and arylalkyl vinyl ethers such as benzyl vinyl ether.

The use of vinyl ethers illustrated above either singly or in admixture is included in the embodiments of the present invention.

It is desirable to introduce functional groups into the fluoropolymers of the invention. Suitable functional groups include hydroxyl, epoxy, and carboxyl groups, for example. Such functional groups may be added to modify or improve the fluoropolymer and coating compositions of the invention with respect to solvent solubility, adhesion to substrates, dispersibility of fillers and pigments, and to provide a site for crosslinking.

Hydroxyl groups may be incorporated into the fluoropolymers of the invention by utilizing a small amount of a hydroxyl-containing vinyl ether such as hydroxybutyl vinyl ether, hydroxybutyl allyl ether, cyclohexanediol vinyl ether, or other hydroxyl-containing monomers such as hydroxyl ethyl methacrylate, for example.

Epoxy groups may be incorporated by utilizing small amounts of monomers such as glycidyl vinyl ether, for example, in the preparation of the fluoropolymer.

Introducing a carboxyl group into the fluoropolymers of the present invention may be accomplished by copolymerizing a small amount of a carboxylic acid-containing monomer. Examples of unsaturated carboxylic acid-containing monomers used for this purpose include acrylic acid, methacrylic acid, maleic acid, fumaric acid, itaconic acid, citraconic acid, tetrahydrophthalic acid, maleic anhydride, anhydrous citraconic acid, monomethyl maleate and dimethyl maleate. Carboxyl groups may also be incorporated in the fluoropolymers of the invention by modifying the copolymer such as by reacting a hydroxyl or epoxy group on the copolymer with a polybasic acid anhydride such as succinic anhydride.

The fluoropolymers of the present invention are preferably non-crystalline or of low crystallinity. Usually the fluoropolymers have a crystallinity of 0% as measured by X-ray diffraction. Thus, the present fluoropolymers form highly transparent dried films.

The fluoropolymers of the present invention have a glass transition temperature (Tg) which can vary over a wide range depending on the use of the auxiliarly layer containing the fluoropolymer. Preferably, the Tg is about −40° to +80° C.

The fluoropolymers of the present invention as illustrated hereinbefore are soluble at ordinary temperature in organic solvents, for example, aromatic hydrocarbons such as benzene, toluene and xylene, ketones such as acetone and methyl ethyl ketone, esters such as diethyl ether and dipropyl ether, alcohols such as ethanol, and halogenated hydrocarbons such as trichloromethane, dichloroethane and chlorobenzene.

The present fluoropolymers may be prepared by copolymerizing the aforementioned monomers in the presence of free radical initiators.

Useful initiators in this copolymerization are various kinds of known initiators, including organic peroxides and organic peresters, for example, benzoyl peroxide, dichlorobenzoyl peroxide, dicumyl peroxide, di-tert-butyl peroxide, 2,5-dimethyl2,5-di(per-oxybenzoate)hexine-3, 1,4-bis(tert-butylperoxyisopropyl)benzene, lauroyl peroxide, tert-butyl peracetate, 2,5-dimethyl-2,5-di(tert-butylperoxy)hexine-3, 2,5-dimethyl-2,5-di(tert-butylperoxy)hexane, tert-butyl perbenzoate, tert-butyl perphenyl acetate, tert-butylperisobutylate, tert-butyl persecoctoate, tert-butyl perpivalate, cumyl perpivalate and tert-butyl perdiethyl acetate, and azo compounds, for example, azobisisobutylnitrile and dimethyl azoisobutylate. Of these organic peroxides, preferable are dialkyl peroxides such as dicumyl peroxide, di-tert-butyl peroxide, 2,5-dimethyl-2,5-di(tert-butylperoxy)hexine-3, 2,5-dimethyl-2,5-di(tert-butylperoxy)hexane and 1,4-bis(tert-butylperoxyisopropyl)benzene.

Various fluoroolefin-vinyl ether copolymers useful in the present invention are commercially available from Asahi Glass Co. Ltd., under the tradename Lumiflon® (for example, Lumiflon® LF-200, LF-302, LF-400, LF-552, LF-601, FL-916, LF-9200, LF-200F, LF-710F, and LF-810).

Related fluoropolymers have been described, for example, in U.S. Pat. Nos. 4,314,043, 4,487,893, 4,701,508, 4,751,114, 4,897,457, 4,910,276, 5,510,406, and 5,532,304. Their use in imaging elements was not disclosed. A protective film for radiographic intensifying screens containing a fluoroolefin-vinyl ether copolymer has been described in U.S. Pat. Nos. 5,460,916, 5,462,832, 5,475,229, 5,482,813, and 5,576,160. Their utility in an improved auxiliary layer for imaging elements was not disclosed.

Auxiliary layers of the present invention may comprise a fluoroolefin-vinyl ether copolymer in combination with other compatible organic solvent soluble polymers such as acrylics, cellulosics, and the like or the solvent-dispersible polymer particles described in U.S. Pat. Nos. 5,597,680 and 5,597,681. Preferably, the auxiliary layer contains at least 10% by weight of the fluoroolefin-vinyl ether copolymer.

The auxiliary layer compositions in accordance with the invention may also contain suitable crosslinking agents including aldehydes, epoxy compounds, polyfunctional aziridines, vinyl sulfones, methoxyalkyl melamines, triazines, polyisocyanates, dioxane derivatives such as dihydroxydioxane, carbodiimides, and the like. The crosslinking agents may react with the functional groups present on the fluoroolefin-vinyl ether copolymer, and/or the solution polymer present in the coating composition.

Matte particles well known in the art may also be used in the auxiliary layer compositions of the invention, such matting agents have been described in Research Disclosure No. 308119, published Dec 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include: hydroxyl, carboxyl, carbodiimide, epoxide, aziridine, vinyl sulfone, sulfinic-acid, active methylene, amino, amide, allyl, and the like.

Other additional compounds that can be employed in the auxiliary layer compositions of the invention include surfactants, coating aids, inorganic fillers such as non-conductive metal oxide particles, conductive metal oxide particles, carbon black, magnetic particles, pigments, lubricants, dyes, biocides, UV and thermal stabilizers, and other addenda well known in the imaging art.

The auxiliary layer compositions of the present invention may be applied as solvent coating formulations containing up to 20% total solids by coating methods well known in the art. For example, hopper coating, gravure coating, skim pan/air knife coating, spray coating, and other methods may be used with very satisfactory results. The coatings are dried at temperatures up to 150° C. to give dry coating weights of 20 mg/m$^2$ to 10 g/m$^2$.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein,-pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver-halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a-dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The following examples are used to illustrate the present invention. However, it should be understood that the invention is not limited to these illustrative examples.

EXAMPLE 1 AND COMPARATIVE SAMPLE A

The following examples show that the coating compositions of the invention provide transparent films with excellent frictional characteristics (i.e., low coefficient of friction values) before and after film processing, low charging characteristics, good abrasion resistance, and that protect an underlying antistatic layer from attack by film processing solutions. A backing layer coating composition comprising a fluoroolefin-vinyl ether copolymer and a comparative composition comprising polymethyl methacrylate which has been widely used as a film backing layer were applied from an 80/20 acetone/methanol solvent mixture containing 4% solids.

These coating compositions both had excellent solution stability and gave transparent, dried layers when applied onto a polyester film support that had been previously coated with a Ag-doped vanadium pentoxide containing antistatic layer. The backing layers were applied at a dry coating weight of 1000 mg/m$^2$.

The coefficient of friction (COF) before and after processing in a Graphic Arts (black and white) film processor for the dried coatings was determined using the method set forth in ANSI IT 9.4-1992. The permanence of the antistatic properties was determined by comparing the internal resistivity (using the salt bridge method, described in R. A. Elder, "Resistivity Measurements on Buried Conductive Layers", EOS/ESD Symposium Proceedings, Sept. 1990, pages 251–254.) for the samples at 20% relative humidity before and after film processing in a Graphic Arts film processor. Impact charge was determined by the following test. The backing layer on a 35 mm by 12 film sample was exposed to a high pressure, short duration contact with a 11 mm diameter stainless steel reference head and the total charge generated on the reference head was measured. The surface charge for the backing layer has an equal, but, opposite charge to that for the reference head. The surface charge for the backing layer was reported in $\mu$C/cm$^2$. The compositions and the results for these coatings are listed in Table 1.

EXAMPLE 2 AND COMPARATIVE SAMPLE B

The following example demonstrates that the fluoropolymers of the invention may be coated in combination with other polymers such as the solvent-dispersible polymer particles described in U.S. Pat. No. 5,597,680. A backing layer composition comprising a mixture of Lumiflon® LF-552 and a solvent-dispersible polymer particle comprising a crosslinked poly methyl methacrylate core and a poly(methyl methacrylate-co-methacrylic acid) shell was applied onto a cellulose acetate support previously coated with a Ag-doped vanadium pentoxide containing antistatic layer. The backing layer contained 10 weight % Lumiflon® LF-552 (Asahi Glass Co. Ltd.)and was applied at a dry coating weight of 800 mg/m$^2$. Comparative sample B had a backing layer that comprised only the solvent-dispersible polymer particle. The coatings were tested for coefficient of friction, permanence of antistatic properties, and abrasion resistance. Abrasion resistance was determined according to the method set forth in ASTM D1044. The results are tabulated in Table 2.

TABLE 1

| Coating | Polymer | COF before processing | COF after processing | Resistivity before processing | Resistivity after processing | Impact charge $\mu$C/cm$^2$ |
|---|---|---|---|---|---|---|
| Sample A | Elvacite 2041* | .50 | .50 | $1 \times 10^7$ Ω/□ | $1 \times 10^7$ Ω/□ | +205 |
| Example 1 | Lumiflon ® LF-200F** | .35 | .35 | $1 \times 10^7$ Ω/□ | $1 \times 10^7$ Ω/□ | +4.5 |

*-ICI Acrylics Inc.
**-Asahi Glass Co. Ltd.

TABLE 2

| Coating | COF | Taber Abrasion, % Δ haze | Resistivity before processing | Resistivity after processing |
|---|---|---|---|---|
| Sample B | .49 | 19 | $3 \times 10^7$ Ω/□ | $3 \times 10^7$ Ω/□ |
| Example 2 | .39 | 18 | $3 \times 10^7$ Ω/□ | $3 \times 10^7$ Ω/□ |

The results show that incorporation of as little as 10 weight % of the fluoropolymers of the invention into a backing layer containing solvent-dispersible polymer particles provides reduced coefficients of friction while maintaining the excellent other physical properties of the polymer particles.

EXAMPLE 3

The following example demonstrates that auxiliary layers of the invention may be prepared using a coating composition comprising fluoroolefin-vinyl ether copolymers and conductive particles. A coating containing 25 weight % Lumiflon® LF-552 and 75 weight % of conductive zinc antimonate particles described in U.S. Pat. No. 5,368,995 was applied onto polyester support. The dry coating weight of the layer was 1000 mg/m$^2$. The coefficient of friction for the layer was measured to be 0.35 and the surface resistivity determined using a two-point probe was $8.0\times10^8$ Ω/□.

While there has been shown and described what are at present the preferred embodiments of the invention, various modifications and alterations will be obvious to those skilled in the art. All such modifications and alterations are intended to be included in the following claims.

What is claimed is:

1. An imaging element comprising:

a support;

at least one silver halide emulsion layer; and an auxiliary layer formed by the steps comprising;

providing a coating composition comprising a fluoroolefin-vinyl ether copolymer in an organic solvent;

coating said coating composition on said support; and drying said coating composition.

2. The imaging element of claim 1, wherein said fluoroolefin is selected from the group consisting of fluoroethylenes, fluoropropenes, vinylidene fluoride, hexafluoropropylene, and pentafluoropropylene.

3. The imaging element of claim 1 wherein the vinyl ether is selected from the group consisting of alkyl vinyl ethers, cycloalkyl vinyl ethers, aryl vinyl ethers and arylalkyl vinyl ethers.

4. The imaging element of claim 1 wherein the fluoroolefin-vinyl ether copolymer further comprises hydroxyl functional groups, epoxy functional groups, or carboxyl functional groups.

5. The imaging element of claim 1 wherein the fluoroolefin-vinyl ether copolymer has a crystallinity of 0 percent.

6. The imaging element of claim 1 wherein the fluoroolefin-vinyl ether copolymer has a glass transition temperature of from −40° to +80° C.

7. The imaging element of claim 1 wherein the coating composition further comprisies crosslinking agents, matte particles, surfactants, coating aids, inorganic fillers, magnetic particles, pigments, lubricants, dyes, biocides, UV stabilizers, or thermal stabilizers.

8. The imaging element of claim 1 wherein the organic medium of said coating composition is selected from the group consisting of aromatic hydrocarbons, ketones, esters, alcohols and halogenated hydrocarbons.

9. An electrophotographic element comprising:

a support;

at least one electrophotographic image-forming layer; and an auxiliary layer formed by the steps comprising;

providing a coating composition comprising a fluoroolefin-vinyl ether copolymer in an organic solvent;

coating said coating composition on said support; and drying said coating composition.

10. An electrostatographic element comprising:

a support;

at least one electrostatographic image-forming layer; and an auxiliary layer formed by the steps comprising;

providing a coating composition comprising a fluoroolefin-vinyl ether copolymer in an organic solvent;

coating said coating composition on said support; and drying said coating composition.

11. A photothermographic element comprising:

a support;

at least one photothermographic image-forming layer; and an auxiliary layer formed by the steps comprising;

providing a coating composition comprising a fluoroolefin-vinyl ether copolymer in an organic solvent;

coating said coating composition on said support; and drying said coating composition.

12. A migration element comprising:

a support;

at least one migration image-forming layer; and an auxiliary layer formed by the steps comprising;

providing a coating composition comprising a fluoroolefin-vinyl ether copolymer in an organic solvent;

coating said coating composition on said support; and drying said coating composition.

13. An electrothermographic element comprising:

a support;

at least one electrothermographic image-forming layer; and an auxiliary layer formed by the steps comprising;

providing a coating composition comprising a fluoroolefin-vinyl ether copolymer in an organic solvent;

coating said coating composition on said support; and drying said coating composition.

14. A dielectric recording element comprising:

a support;

at least one dielectric recording image-forming layer; and an auxiliary layer formed by the steps comprising;

providing a coating composition comprising a fluoroolefin-vinyl ether copolymer in an organic solvent;

coating said coating composition on said support; and drying said coating composition.

15. A thermal dye transfer element comprising:

a support;

at least one thermal dye transfer image-forming layer; and an auxiliary layer formed by the steps comprising;

providing a coating composition comprising a fluoroolefin-vinyl ether copolymer in an organic solvent;

coating said coating composition on said support; and drying said coating composition.

* * * * *